US005785035A

United States Patent [19]

Mitani et al.

[11] Patent Number: 5,785,035

[45] Date of Patent: Jul. 28, 1998

[54] IGNITION DEVICE WITH SERIES GAP HAVING SHIELDING CASE

[75] Inventors: Tetsuya Mitani, Susono; Shigehiko Mochizuki; Hiroshi Suzuki, both of Gotenba, all of Japan

[73] Assignee: Yazaki Corporation, Tokyo, Japan

[21] Appl. No.: 755,654

[22] Filed: Nov. 25, 1996

Related U.S. Application Data

[63] Continuation of Ser. No. 350,010, Nov. 29, 1995, abandoned.

[30] Foreign Application Priority Data

Nov. 30, 1993 [JP] Japan ..... 5-299881
Nov. 22, 1994 [JP] Japan ..... 6-287869

[51] Int. Cl.[6] ..... F02P 11/00

[52] U.S. Cl. ..... 123/633; 123/169 PH

[58] Field of Search ..... 123/633, 169 PA, 123/169 PH, 627

[56] References Cited

U.S. PATENT DOCUMENTS

| | | | |
|---|---|---|---|
| 1,245,931 | 11/1917 | Lanman | 123/169 PH |
| 1,993,014 | 3/1935 | Mascuch | 123/169 PH |
| 1,994,614 | 3/1935 | Lansing | 123/169 PH |
| 1,994,882 | 3/1935 | Cadieux | 123/169 PH |
| 2,686,509 | 8/1954 | Drinkard | 123/169 PH |
| 3,191,133 | 6/1965 | Texsier | 123/633 |
| 3,965,879 | 6/1976 | Fitzner | 123/633 |
| 5,163,838 | 11/1992 | Tura et al. | 123/169 PA |

FOREIGN PATENT DOCUMENTS 63-101486 7/1988 Japan .

*Primary Examiner*—Noah P. Kamen
*Attorney, Agent, or Firm*—Nikaido, Marmelstein, Murray & Oram LLP

[57] ABSTRACT

An ignition device with a series gap includes a series gap assembly having therein a discharge tube. A shielding case is provided to cover the series gap assembly. The shielding case is made of a conductive material and arranged to be in contact with a cylinder head or an engine block so that electrical continuity is held between the shielding case and the cylinder head or the engine block. Accordingly, the shielding case effectively works to provide a reliable electric shielding between the exterior and interior of the shielding case so that electromagnetic wave caused by sparking of the discharge tube is prevented from leaking outside and an ambient electric field is prevented from affecting a discharge characteristic of the discharge tube.

16 Claims, 7 Drawing Sheets

FIG. 7
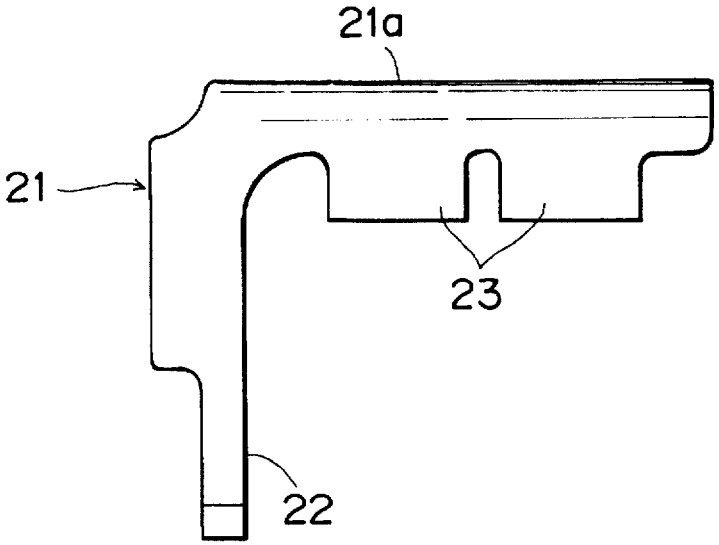
FIG. 10
FIG. 9
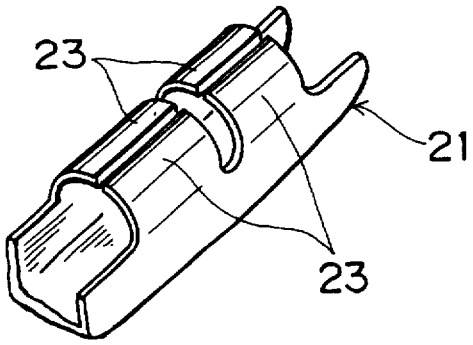
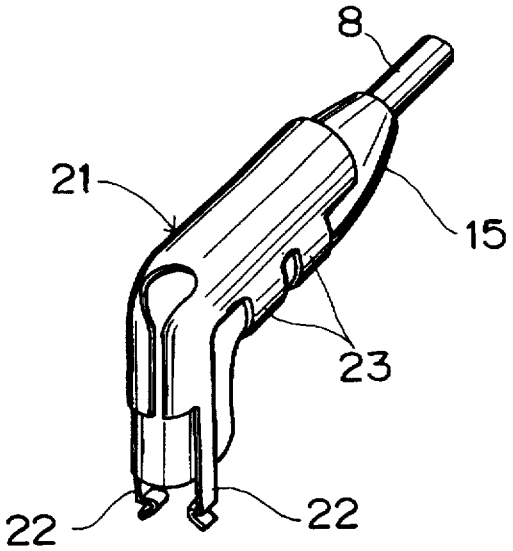

IGNITION DEVICE WITH SERIES GAP HAVING SHIELDING CASE

This application is a continuation of application Ser. No. 08/350,010 filed Nov. 29, 1995, now abandoned.

BACKGROUND OF THE INVENTION

1. Field of the Invention

The present invention relates to an ignition device with a series gap for use with a spark plug of, such as, an internal combustion engine of an automotive vehicle.

2. Description of the Prior Art

Ignition devices with series gaps have been proposed as disclosed in, Japanese Utility Model Publication Application Laid Open No. 63-101486 for preventing spark plugs used in the automotive gasoline engines from being sooted so as to disable sparking due to adhesion of carbon to the spark plugs. FIG. 15 shows one of such ignition devices. In FIG. 15, the ignition device includes a plug cap d fitted over a spark plug e which is mounted to a cylinder head f. The plug cap d accommodates therein a discharge tube c having a pair of electrodes a, a' which forms a series gap b therebetween.

Since this type of ignition device includes the discharge tube c in the plug cap d, the problem is raised in that the electromagnetic wave caused by sparking in the discharge tube c may leak externally so as to adversely affect peripheral devices, such as a microcomputer used for an ignition timing control.

In recent automotive engines, double overhead camshaft (DOHC) type systems have been prevalent. In this type of engine, as shown in FIG. 16, a spark plug e is mounted at a bottom a plug hole g formed in a cylinder head f so that an ignition device S with a series gap is encircled by the cylinder head f. On the other hand, the automotive engines having no such plug holes g have also been available, such as, rotary engines. In this case, as shown in FIG. 17, an ignition device S with a series gap is arranged external of a cylinder head f so as to be exposed.

Since the cylinder head f is set to ground potential, an electric field around the spark plug e largely varies depending on the configuration of the cylinder head f around the spark plug e. As can be appreciated, the electric field around the spark plug e causes substantial influence on the discharge characteristic of a discharge tube c' of the ignition device S which is mounted over the spark plug e.

Therefore, it has been necessary to adjust a discharge voltage of the discharge tube c' according to an individual engine while the ignition device S is mounted over the spark plug e, which is quite burden some.

SUMMARY OF THE INVENTION

It is therefore, an object of the present invention to provide an improved ignition device with a series gap which, by producing shielding case to a plug cap having therein a discharge tube, prevents electromagnetic wave caused by sparking of the discharge tube from leaking outside and further prevents an ambient electric field from adversely affecting a discharge characteristic of the discharge tube.

According to a first aspect of the present invention, an ignition device with a series gap comprises a plug cap including therein a discharge tube, the discharge tube having a pair of electrodes which form a series ga therebetween, the plug cap provided between a high tension cord and a spark plug for applying a high voltage to the spark plug; and a tubular shielding case encircling the discharge tube, the tubular shielding case having abutment lug for connection to a ground potential.

According to a second aspect of the present invention, in the foregoing ignition device according to the first aspect, the tubular shielding case may form a portion of the plug gap.

According to a third aspect of the present invention, in the foregoing ignition device according to the first aspect, the tubular shielding case may be resiliently abutted against a cylinder head via the abutment lug.

According to a fourth aspect of the present invention, in the foregoing ignition device according to the first aspect, the tubular shielding case may be formed with small holes for air ventilation.

According to a fifth aspect of the present invention, an ignition device with a series gap comprises a plug cap including therein a discharge tube, the discharge tube having a pair of electrodes which form a series gap therebetween, the plug cap provided between a high tension cord and a spark plug for applying a high voltage to the spark plug; and a tubular shielding case encircling the plug cap, the tubular shielding case having an abutment lug for connection to a ground potential.

According to a sixth aspect of the present invention, in the foregoing ignition device according to the fifth aspect, the tubular shielding may be resiliently abutted against a cylinder head via the abutment lug.

According to a seventh aspect of the present invention, in the foregoing ignition device according to the fifth aspect, the tubular shielding case may be formed by bending a conductive metallic plat to follow the contour of the plug cap.

According to an eighth aspect of the present invention, in the foregoing ignition device according to the fifth aspect, the tubular shielding case may be formed with small holes for ventilation.

According to a ninth aspect of the present invention, an ignition device with series gap comprises a plug cap including therein a discharge tube, the discharge tube having a pair of electrodes which form a series gap therebetween, the plug cap provided between a high tension cord and a spark plug for applying a high voltage to the spark plug; and a shielding case of a box type covering the plug cap, the shielding case mounted onto an engine block around the spark plug and arranged to be opened or closed relative to the plug cap.

According to a tenth aspect of the present invention, in the foregoing ignition device according to the ninth aspect, the shielding case may be semicircular in section.

According to an eleventh aspect of the present invention, the foregoing ignition device according to the ninth aspect, the shielding case may be formed with small holes for air ventilation.

As can be appreciated, in the ignition devices according to the present invention, the shielding case is connected to a ground potential. Accordingly, electromagnetic wave caused by sparking of the discharge tube is reliably screened by the shielding case so as to prevent the electromagnetic wave from leaking outside to adversely affect a peripheral device. Further, since an ambient electric field is also reliably screened by the shielding case, a stable discharging characteristic of the discharge tube is ensured.

Further, when the shielding case is formed with the small holes for air ventilation, overheating within the shielding case may be effectively prevented.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings:

FIG. 7 is a front view showing a shielding case which is a modification of the shielding case shown is FIGS. 3 to 6;

FIG. 9 is a perspective view showing holding lugs of the shielding case shown in FIG. 7 and 8;

FIG. 10 is a perspective view showing an ignition device with a series gap, wherein the shielding case shown in FIGS. 7 to 9 is mounted onto a plug cap of the ignition device;

DESCRIPTION OF THE PREFERRED EMBODIMENT

Now, preferred embodiments of the present invention will be described hereinbelow with reference to the accompanying drawings.

Figure 2:
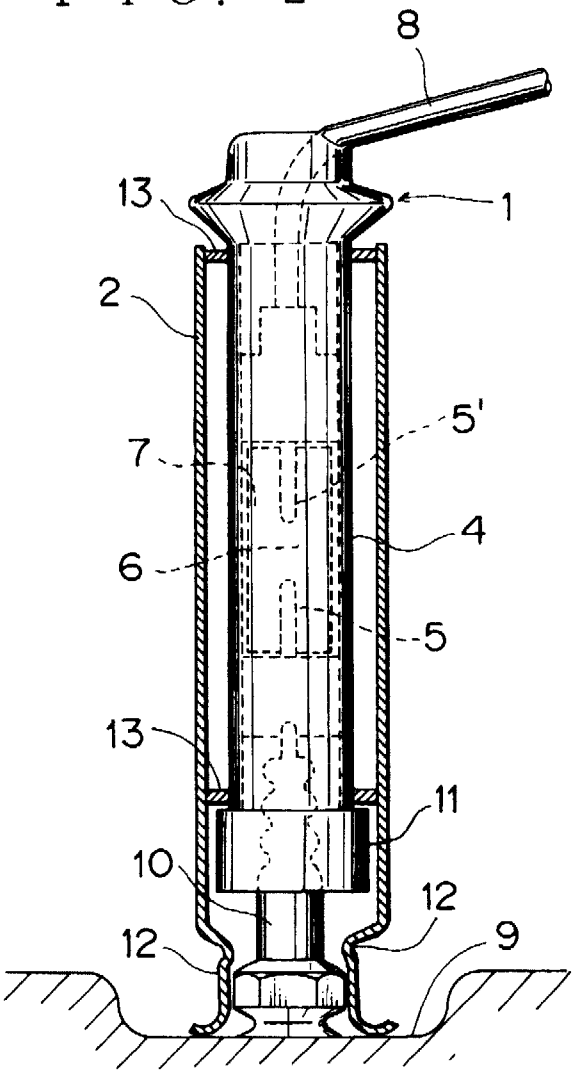
FIG. 2 is a side view of the ignition device shown in FIG. 1, with a shielding case being sectioned.
Figure 1:
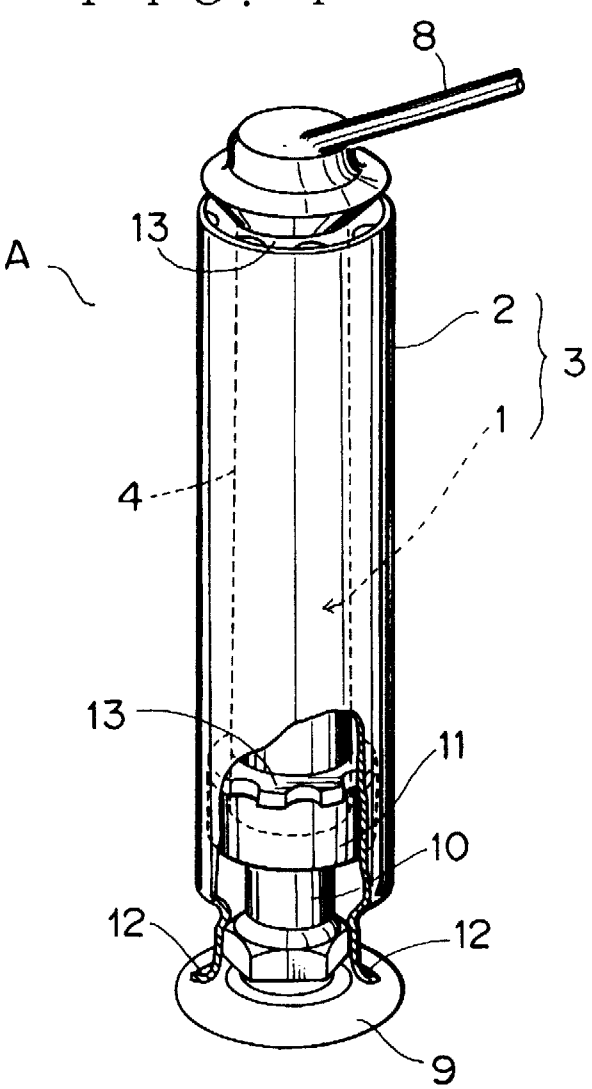
FIG. 1 is a partly-broken perspective view showing an ignition device with a series gap according to a first preferred embodiment of the present invention.

FIG. 1 is a partly-broken perspective view showing an ignition device A with a series gap according to a first preferred embodiment of the present invention, and FIG. 2 is a side view thereof.

In these figures, the ignition device A includes a plug cap 3 which is composed of a series gap assembly 1 and a shielding case 2 encircling the series gap assembly 1.

The series gap assembly 1 includes a tubular casing 4 formed of an insulating material, such as, synthetic resin. The tubular casing 4 accommodates therein a discharge tube 7 having a pair of electrodes 5, 5' which forms a series gap 6 therebetween. The series gap assembly 1 works to supply, via the discharge tube 7, a high-tension current fed from a high tension cord 8 to spark plug 10 mounted onto a cylinder head 9 of an internal combustion engine. Numeral 11 represents a rubber cap fitted over the spark plug 10.

The shielding case 2 has a tubular shape and is formed of a metallic material, such as, iron, stainless steel or aluminum. At a lower end portion of the shielding case 2 is provided with a plurality of abutment lugs 12 each formed into a bent or flexed shape for resilient abutment with the cylinder head 9. Each abutment lug 12 may be formed integral with the shielding case 2 and of the same material into such a bent shape. On the other hand, each abutment lug 12 may also be formed separately and of a flexible material and then attached to the shielding case 2.

At an upper end portion and an intermediate portion of the shielding case 2, supporters 13 are made of synthetic resin or rubber are interposed between the shielding case 2 and the tubular casing 4 so as to ensure a given proper gap therebetween.

The plug cap 3 as structured above can be easily mounted onto the spark plug 10 by pressing the plug cap 3 onto the spark plug 10 like the known plug cap. Accordingly, the working efficiency of mounting the plug cap is not deteriorated.

Figure 3:
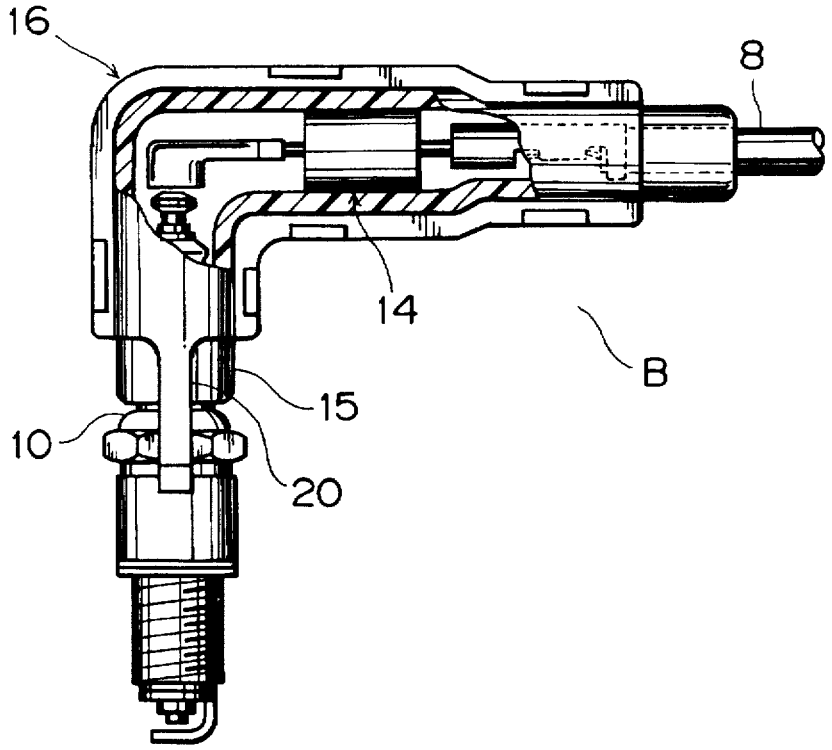
FIG. 3 is a partly-broken front view showing an ignition device with a series gap according to a second preferred embodiment of the present invention.
Figure 4:
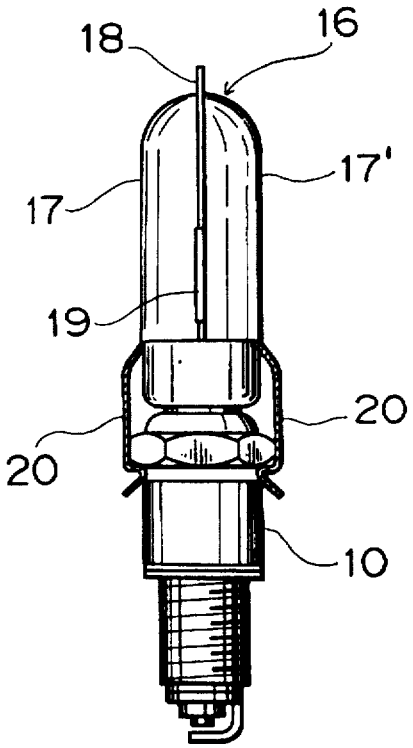
FIG. 4 is a side view of the ignition device shown in FIG. 3, with abutment lugs of a shielding case being sectioned.

FIG. 3 is a partly-broken front view showing an ignition device B with a series gap according to a second preferred embodiment of the present invention, and FIG. 4 is a side view of thereof.

In these figures, the ignition device B is shown as being mounted over the spark plug 10 as in FIGS. 1 and 2. The ignition device B includes a plug cap 15 having therein a series gap assembly 14, and further includes a shielding case 16 encircling the plug cap 15. The series gap assembly 14 accommodates therein a discharge tube as in the first preferred embodiment, and numeral 8 denotes the high tension cord also as in the first preferred embodiment.

Figure 5:
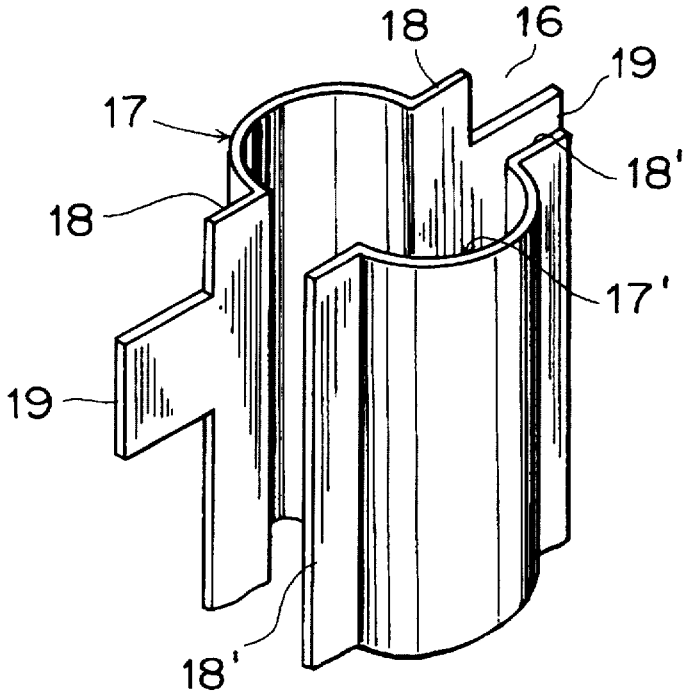
FIG. 5 is a perspective view showing two half cases which form the shielding case shown in FIGS. 3 and 4.
Figure 6:
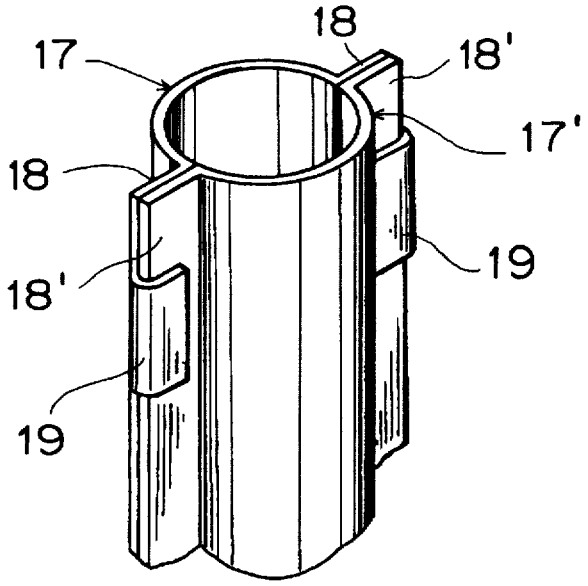
FIG. 6 is a perspective view showing the assembled state of the two half cases shown in FIG. 5.

As shown in FIGS. 5 and 6, the shielding case 16 is composed of two halves or cases 17 and 17' each being semicircular in section. Each of the semicircular case 17 and 17' is formed by pressing a conductive metallic plate, and provided with mounting flanges 18, 18 or 18', 18' at both peripheral edges thereof. At proper positions of each mounting flange 18 of the case 17, folding lugs 19 are protrudently formed. Although FIGS. 5 and 6 show only a portion of each of the cases 17 and 17', each case is formed corresponding to configuration of the plug cap 15 as seen from FIG. 3, and formed at its lower end portion with abutment lug 20 for resilient abutment with a cylinder head (not shown).

As shown in FIG. 6 the tubular shielding case 16 is assembled by confronting the mounting flanges 18 and 18' of the cases 17 and 17' in abutment with each other and then by folding the lugs 19 to couple the confronting mounting flanges 18 and 18'.

As appreciated, in the ignition device B according to the second preferred embodiment, since the shielding case 16 is formed by assembling the two halves 17 and 17', it is easy to mount the shielding case 16 onto the plug cap 15.

Figure 8:
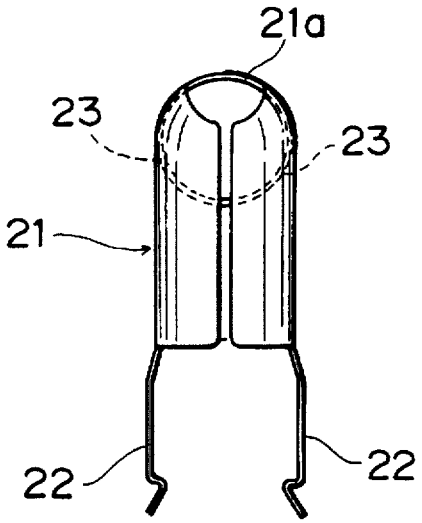
FIG. 8 is a side view showing the shielding case shown in FIG. 7.

FIGS. 7 and 8 show a shielding case 21 which is a modification of the shielding case 16 of the ignition device B. FIG. 7 is a front view of the shielding case 21, and FIG. 8 is a side view thereof.

According to this modification, the shielding case 21 is formed by pressing one conductive metallic plate.

Specifically, the shielding case 21 includes abutment lugs 22 and holding lugs 23 which are arranged symmetrically with respect to a center axis at a top portion 21*a* of the shielding 21. The shielding case 21 is mounted onto the plug cap 15 shown in FIG. 3 by pressing so as to bend or fold the shielding case 21 so as to follow the contour of the plug cap 15 as shown in FIGS. 9 and 10. FIG. 9 is a perspective view showing configuration of the holding lugs 23 of the shielding case 21, and FIG. 10 is a perspective view showing the shielding case 21 as being mounted onto the plug cap 15.

Figure 11:
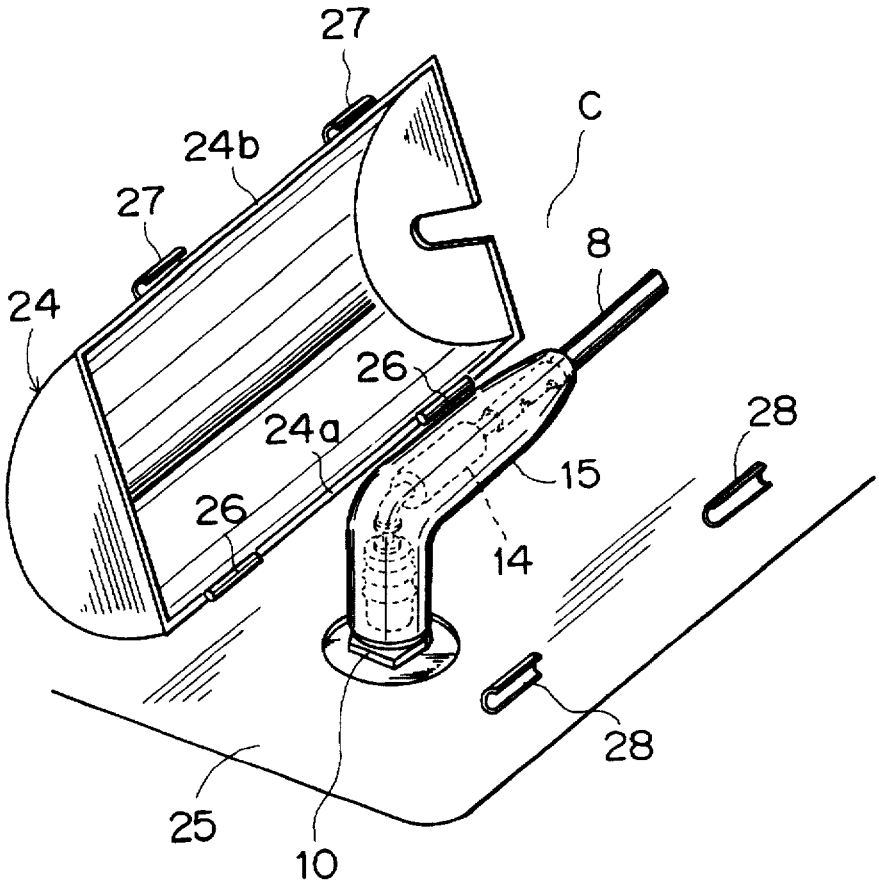
FIG. 11 is a perspective view showing an ignition device with a series gap according to a third preferred embodiment of the present invention.
Figure 12:
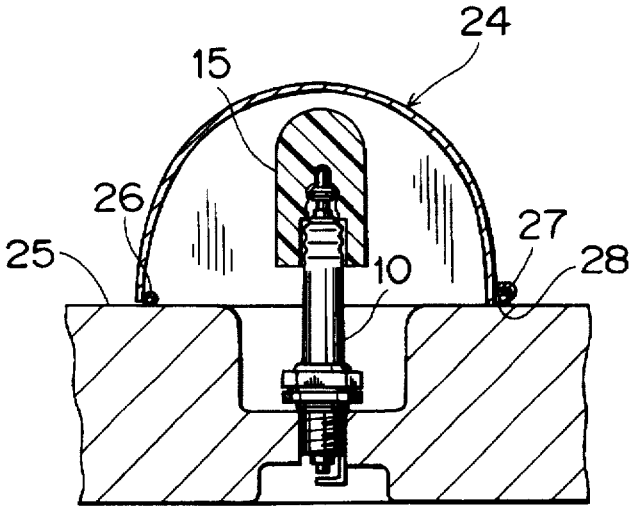
FIG. 12 is a side sectional view of the ignition device shown in FIG. 11.

FIG. 11 is a perspective view showing an ignition device C with a series gap according to a third preferred embodiment of the present invention, and FIG. 12 is a side sectional view thereof.

In these figures, the ignition device C includes a shielding case 24 of a box type which is semicircular in section and covers the plug cap 15 fitted over the spark plug 10 which is mounted onto an engine block 25. The plug cap 15 is the same as that in the second preferred embodiment and thus also includes the series gap assembly 14 as in the second preferred embodiment. Numeral 8 denotes the high tension cord which is also the same as that in the second preferred embodiment.

The shielding case 24 has one peripheral edge 24*a* which is mounted to the engine block 25 by means of hinges 26. Accordingly, the shielding case 24 can be closed to cover the entirety of the plug cap 15 fitted over the spark plug 10 and opened to expose the plug cap 15 to the exterior. The shielding case 24 further has the other peripheral edge 24*b* provided with locking hooks 28 fixedly provided on the engine block 25 so as to secure the shielding case 24 relative to the engine block 25 while the shielding case 24 is closed.

Although the shielding case 24 of the ignition device C has no abutment lugs corresponding to the abutment lugs 12, 20 or 22 in the foregoing preferred embodiments, the electrical continuity between the shielding case 24 and the engine block 25 is ensured via the hinges 26 and via the engagement between the locking pawls and hooks 27 and 28. Accordingly, the reliable shielding can be provided for the discharge tube in the series gap assembly 14.

Figure 13:
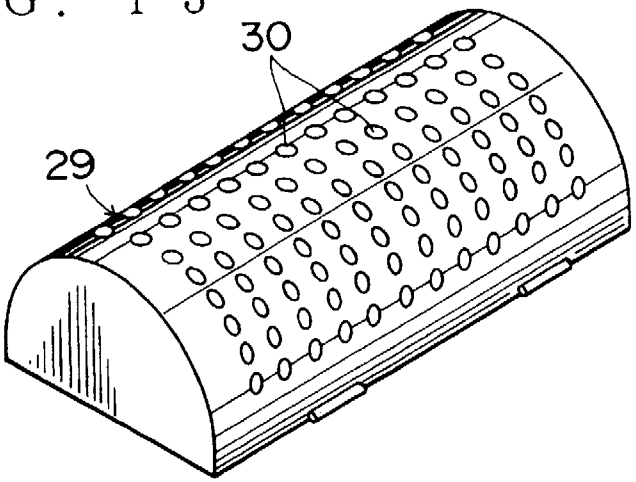
FIG. 13 is a perspective view showing a shielding case which is a modification of the shielding case shown in FIGS. 11 and 12.

FIG. 13 is a perspective view showing a shielding case 29 which is a modification of the shielding case 24 of the ignition device C. As shown in FIG. 13, the shielding case 29 is formed with small holes for air ventilation over the entire surface of the shielding case 29. The other structure is the same as that of the shielding case 24.

Since the shielding case 29 includes the air vent holes 30, the heat generated by the series gap assembly 14 in the plug cap 15 is easily allowed to escape so that the overheating can be prevented effectively.

Figure 14:
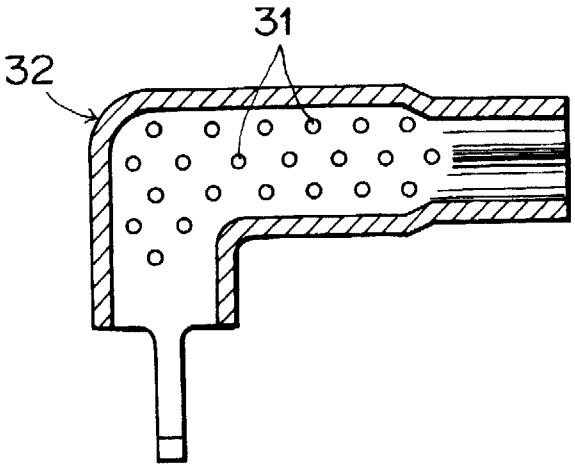
FIG. 14 is a front sectional view showing a shielding case which is a modification of the shielding case shown in FIGS. 3 to 6.
Figure 15:
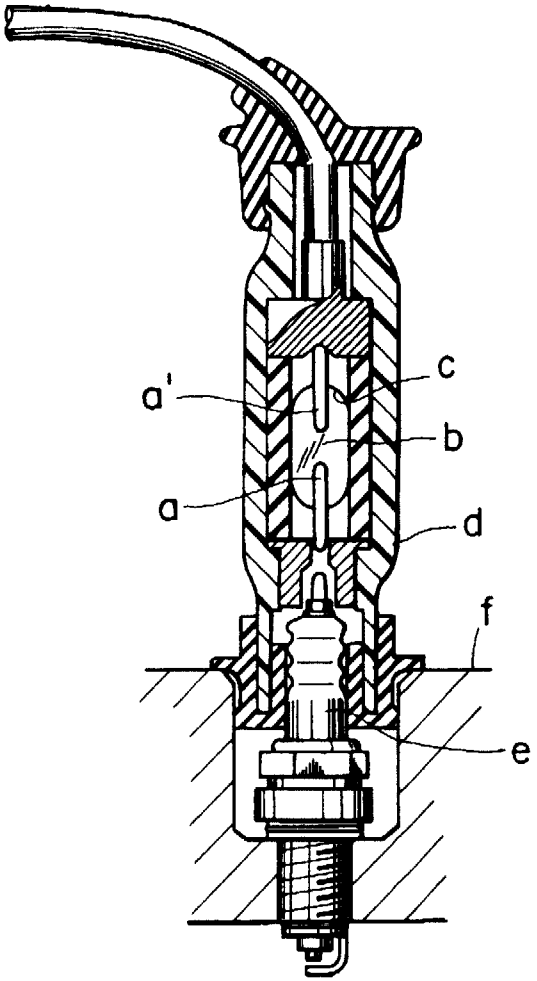
FIG. 15 PRIOR ART
FIG. 15 is a sectional view showing a conventional ignition device with a series gap.
Figure 17:
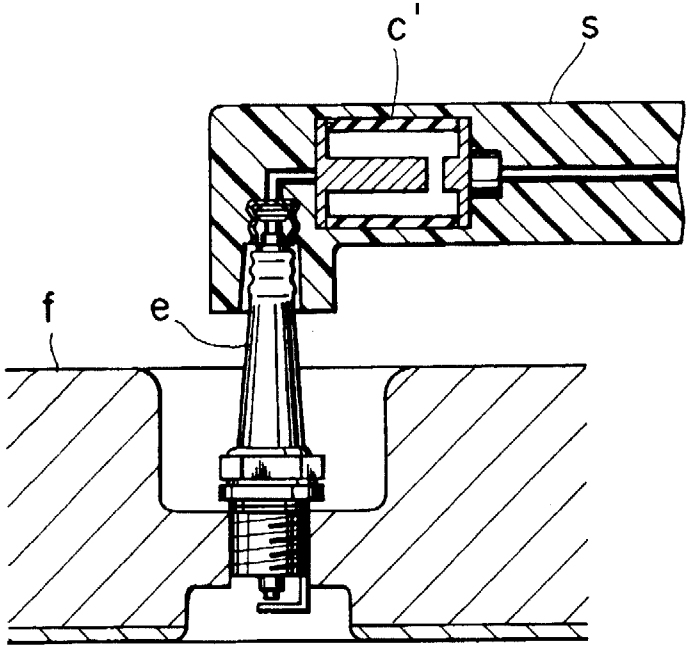
FIG. 17 PRIOR ART
FIG. 17 is an explanatory diagram showing the state where a conventional ignition device with a series gap is fitted over a spark plug mounted to a cylinder head of an internal combustion engine having no plug hole.
Figure 16:
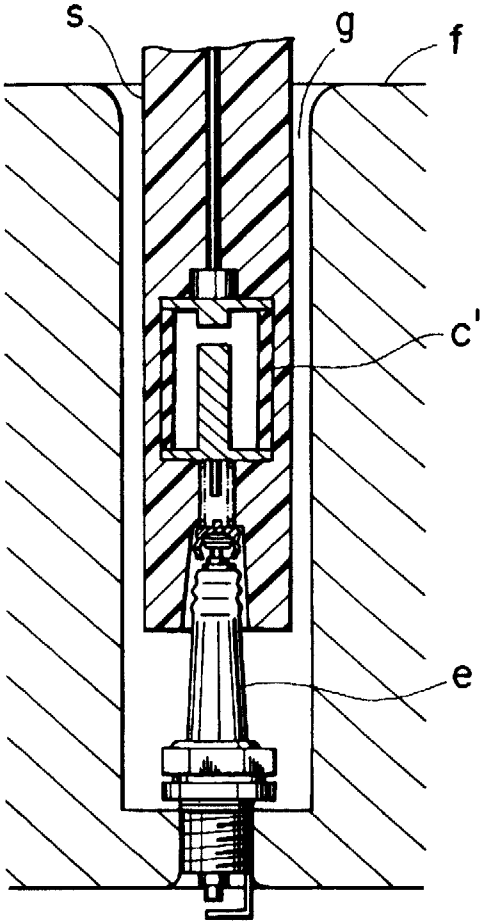
FIG. 16 PRIOR ART
FIG. 16 is an explanatory diagram showing the state where a conventional ignition device with a series gap is mounted in a plug hole formed at a cylinder head of an internal combustion engine.

FIG. 14 is a front sectional view showing a shielding case 32 which is a modification of the shielding case 16 of the ignition device B. As shown in FIG. 14, the shielding 32 is formed with small holes 31 for air ventilation. The shielding case 32 also works to prevent the overheating within the shielding case 32.

As appreciated, the shielding case 2 shown is FIGS. 1 and 2 or the shielding case 21 shown in FIGS. 7 to 10 may also have air vent holes in FIG. 13 or 14.

In the foregoing first to third preferred embodiments, the shielding case held in electrical continuity with the cylinder head or the engine block is provided so as to cover the discharge tube having the series gap therein. Accordingly, the electromagnetic wave caused by sparking of the discharge tube is reliably screened or blocked by the shielding case so as to prevent the electromagnetic wave from leaking outside to adversely affect the peripheral devices. Further, the shielding case prevents the ambient electric field from affecting the interior of shielding case so that the discharge characteristic of the discharge tube is held stable. Moreover, the ignition device, having such a shielding case can be mounted onto or dismounted from the spark plug like known ignition device, that is, without any particular operation required. Further, by providing the air vent holes in the shielding case, the overheating within the plug cap can be effectively prevented.

It is to be understood that this invention is not to be limited to the preferred embodiments and modifications described above, and that various changes and modifications may be made without departing from the spirit and scope of the invention as defined in the appended claims.

What is claimed is:

1. An ignition device with a series gap, comprising:

a plug cap including therein a discharge tube, said discharge tube having a pair of electrodes which form a series gap therebetween, said plug cap provided between a high tension cord and a spark plug for applying a high voltage to said spark plug; and a tubular shielding case means encircling said discharge tube with a predetermined uniform space therefrom for preventing an ambient electric field from affecting a discharge characteristic of said discharge tube and holding the discharge characteristic thereof stable, said tubular shielding case means having means for connection to ground potential; said means for connection to ground potential comprising an abutment lug formed on said tubular shielding case means, said lug being resiliently abutted against a cylinder head.

2. The ignition device as set forth in claim 1, wherein said tubular shielding case means forms a portion of said plug cap.

3. The ignition device as set forth in claim 1, wherein said tubular shielding case means is formed with a large plurality of uniformly distributed small holes for air ventilation.

4. The ignition device as set forth in claim 1, wherein said tubular shielding case means encircles said plug.

5. The ignition device as set forth in claim 4, wherein said means for connection to ground potential comprises an abutment lug formed on said tubular shielding case means, said lug being resiliently abutted against a cylinder head.

6. The ignition device as set forth in claim 4, wherein said tubular shielding case means is formed by bending a conductive metallic plate to follow the contour of said plug cap.

7. The ignition device as set forth in claim 4, wherein said tubular shielding case means is formed with a large plurality of uniformly distributed small holes for air ventilation.

8. An ignition device with a series gap, comprising:

a plug cap including therein a discharge tube, said discharge tube having a pair of electrodes which form a series gap therebetween, said plug cap provided between a high tension cord and a spark plug for applying a high voltage to said spark plug; and a tubular shielding case encircling said plug cap with a predetermined uniform space therefrom for preventing an ambient electric field from affecting a discharge characteristic of said discharge tube and holding the discharge characteristic thereof stable, said tubular shielding case having means for connection to ground potential; said means for connection to ground potential comprising an abutment lug formed on said tubular shielding case, said lug being resiliently abutted against a cylinder head.

9. The ignition device as set forth in claim 8, wherein said tubular shielding case is formed by bending a conductive metallic plate to follow contour of said plug cap.

10. The ignition device as set forth in claim 8, wherein said tubular shielding case is formed with a large plurality of uniformly distributed small holes for air ventilation.

11. An ignition device with a series gap, comprising:

a plug cap including therein a discharge tube, said discharge tube having a pair of electrodes which form a series gap therebetween, said plug cap provided between a high tension cord and a spark plug for applying a high voltage to said spark plug; and a shielding case of a box type mounted onto an engine block around said plug cap covering said plug cap with a predetermined space therefrom, said shielding case together with the engine block being means for preventing an ambient electric field from affecting a discharge characteristic of said discharge tube and for holding the discharge characteristic thereof stable, said shielding case being arranged to be opened or closed relative to said plug cap.

12. The ignition device as set forth in claim 7, wherein said shielding case is semicircular in section.

13. The ignition device as set forth in claim 11, wherein said shielding case is formed with small holes for air ventilation.

14. The ignition device as set forth in claim 11, wherein said shielding case is connected to the ground potential by the mounting onto the engine block around said spark plug.

15. The ignition device as set forth in claim 14, wherein said shielding case is semicircular in cross section.

16. The ignition device as set forth in claim 14, wherein said shielding case is formed with small holes for air ventilation.

* * * * *

UNITED STATES PATENT AND TRADEMARK OFFICE

CERTIFICATE OF CORRECTION

PATENT NO. : 5,785,035

DATED : July 28, 1998

INVENTOR(S) : Mitani et al

It is certified that error appears in the above-identified patent and that said Letters Patent is hereby corrected as shown below:

On the title page,

Item [63], delete "Nov. 29, 1995" insert therefor

-- Nov. 29, 1994 --

Signed and Sealed this

Thirteenth Day of July, 1999

*Attest:*

Q. TODD DICKINSON

*Attesting Officer*

*Acting Commissioner of Patents and Trademarks*